US010850151B1

(12) United States Patent
Orosz

(10) Patent No.: US 10,850,151 B1
(45) Date of Patent: Dec. 1, 2020

(54) AERODYNAMIC DRAG COMPONENT, SYSTEM, AND METHOD FOR SWUNG ATHLETIC IMPLEMENTS

(71) Applicant: William John Orosz, Louisville, KY (US)

(72) Inventor: William John Orosz, Louisville, KY (US)

( * ) Notice: Subject to any disclaimer, the term of this patent is extended or adjusted under 35 U.S.C. 154(b) by 82 days.

(21) Appl. No.: 16/583,954

(22) Filed: Sep. 26, 2019

Related U.S. Application Data

(60) Provisional application No. 62/866,118, filed on Jun. 25, 2019.

(51) Int. Cl.

| | |
|---|---|
| ***A63B 21/008*** | (2006.01) |
| ***A63B 57/00*** | (2015.01) |
| ***A63B 60/00*** | (2015.01) |
| ***A63B 69/36*** | (2006.01) |
| ***A63B 69/00*** | (2006.01) |
| ***A63B 102/32*** | (2015.01) |
| ***A63B 102/18*** | (2015.01) |

(52) U.S. Cl.
CPC ..... *A63B 21/0088* (2013.01); *A63B 57/00* (2013.01); *A63B 60/00* (2015.10); *A63B 69/0002* (2013.01); *A63B 69/3632* (2013.01); *A63B 2069/0008* (2013.01); *A63B 2102/18* (2015.10); *A63B 2102/32* (2015.10)

(58) Field of Classification Search
CPC ..... A63B 21/0088; A63B 69/0002; A63B 69/3632; A63B 57/00; A63B 60/00; A63B 2102/18; A63B 2102/32; A63B 2069/0008
See application file for complete search history.

(56) References Cited

U.S. PATENT DOCUMENTS

| | | | | |
|---|---|---|---|---|
| 4,330,121 A * | 5/1982 | McCafferty | ..... | A63B 21/0088 473/228 |
| 5,865,686 A * | 2/1999 | MacGregor | ..... | A63B 15/00 473/228 |
| 2003/0207719 A1* | 11/2003 | Hughes | ..... | A63B 15/00 473/228 |

* cited by examiner

*Primary Examiner* — Jeffrey S Vanderveen
(74) *Attorney, Agent, or Firm* — Roberts IP Law; John Roberts

(57) ABSTRACT

An aerodynamic drag component for removably placing on a swung athletic implement may comprise a hollow thin-walled body having an outer profile with a width less than its height and a plurality of spaced-apart perforations with concave lips shaped to scoop air from outside the hollow thin-walled body, through the perforations, and into the hollow thin-walled body to increase aerodynamic drag in a first direction, and convex surfaces opposite the concave lips that are shaped to divert air outside the hollow thin-walled body away from the perforations, to reduce airflow into the hollow thin-walled body to reduce aerodynamic drag in a second direction opposite the first direction, to provide varying aerodynamic drag resistance during a swing. The aerodynamic drag component may freely rotate or freely translate or both on a longitudinally-extending portion of the swung athletic implement. Multiple aerodynamic drag components may be used at once.

22 Claims, 6 Drawing Sheets

AERODYNAMIC DRAG COMPONENT, SYSTEM, AND METHOD FOR SWUNG ATHLETIC IMPLEMENTS

CROSS-REFERENCE TO RELATED APPLICATIONS

The present application claims priority to, incorporates herein by reference, and is a non-provisional of U.S. provisional patent application Ser. No. 62/866,118 filed Jun. 25, 2019 and entitled Wind Resistant Golf Swing and Speed Trainer (herein, "the '118 Application").

FEDERALLY SPONSORED RESEARCH OR DEVELOPMENT

None.

TECHNICAL FIELD

The present invention relates generally to swung athletic implements, such as golf clubs, bats, rackets, and the like, and more particularly to components for such implements that increase aerodynamic drag of the implements when they are swung.

BACKGROUND

Player-swung devices have been known to be equipped with accessories designed to increase aerodynamic drag or air resistance and thereby promote the development of the player's muscular strength and coordination, for instance as described in U.S. Pat. No. 4,330,121 A issued to McCafferty on May 18, 1982 (herein "McCafferty"), which is incorporated herein by reference in its entirety. McCafferty proposes increasing aerodynamic drag or air resistance by placing over and frictionally-engaging with swung athletic implements a hollow, thin-wall sphere up to 18 inches in diameter, which features uniformly-spaced apertures that allow air to pass into and out of the sphere as the athletic implement is swung. Drawbacks of McCafferty's hollow spheres include their large size and bulkiness required to capture enough air to sufficiently increase drag, which would make them difficult to transport and handle, awkward to use, and potentially interfering with the desired swinging-movement. Accordingly, a need has long remained for an improved device.

SUMMARY

The present invention(s) elegantly overcome many of the drawbacks of prior systems and provide numerous additional improvements and benefits as will be apparent to persons of skill in the art. Provided in various example embodiments is an aerodynamic drag component for a swung athletic implement that comprises a longitudinally-extending member, the aerodynamic drag component comprising: a hollow thin-walled body having an inner surface and an outer surface and extending longitudinally from a lower portion to an upper portion and may define there between a height, the outer surface may define an outer profile having a maximum width perpendicular to the height that is less than the height; the outer profile may define a plurality of spaced-apart perforations through the thin-walled body, at least some of the plurality of perforations each may define, on a side of the perforation nearest the upper portion, a concave lip extending outward from the outer surface and shaped to scoop air from outside the hollow thin-walled body, through the perforations, and into the hollow thin-walled body to increase aerodynamic drag, when air moves past the outer profile in a first direction moving from the lower portion toward the upper portion; and first and second openings formed in the lower portion and upper portion, respectively, the first and second openings sized and shaped to receive there through the longitudinally-extending member of the swung athletic implement.

In various example embodiments, the concave lips each may further comprise convex sides opposite the perforations, the convex sides extending outward from the outer surface and shaped to divert air outside the hollow thin-walled body away from the perforations, to reduce airflow into the hollow thin-walled body to reduce aerodynamic drag, when air moves past the outer profile in a second direction opposite the first direction, moving from the upper portion toward the lower portion.

In various example embodiments, the outer surface may define an outer profile having a maximum width perpendicular to the height that is less than or equal to 75 percent of the height. In various example embodiments, the outer surface may define an outer profile having a maximum width perpendicular to the height that is less than or equal to 66 percent of the height. In various example embodiments, the outer surface may define an outer profile having a maximum width perpendicular to the height that is less than or equal to 50 percent of the height.

In various example embodiments, the outer profile may further comprise a cylindrical shape extending between the lower portion and the upper portion. In various example embodiments, the lower portion may further comprise a first rounded surface tapering inward from the cylindrical shape toward the first opening, and the upper portion may further comprise a second rounded surface tapering inward from the cylindrical shape toward the second opening. In various example embodiments, the first rounded surface and the second rounded surface each may further comprise some of the plurality of perforations. In various example embodiments, the first and second openings each define round holes.

In various example embodiments, the aerodynamic drag component may be sized and shaped to rotate freely around a swung athletic implement that comprises a longitudinally-extending member having a maximum cross-sectional width, the first and second openings each defining round holes having diameters larger than the maximum cross-sectional width. In various example embodiments, the aerodynamic drag component may be sized and shaped to freely slide longitudinally on a swung athletic implement that comprises a longitudinally-extending member having a maximum cross-sectional width, the first and second openings each defining round holes having diameters larger than the maximum cross-sectional width.

In various example embodiments, more than one such aerodynamic drag component may be removably attached together, and may further comprise the upper portion and the lower portion being sized and shaped so that the upper portion of a first aerodynamic drag component can fixedly and removably engage with the lower portion of a second aerodynamic drag component.

Further provided in various example embodiments is an aerodynamic drag system, comprising an aerodynamic drag component as described herein, mounted on a swung athletic implement that comprises a longitudinally-extending member extending through the first and second openings. In various example embodiments, the swung athletic implement comprises a golf club. In various example embodiments, the swung athletic implement comprising a golf club comprises a longitudinally extending golf club shaft having a maximum cross-sectional width, the first and second openings each defining round holes having diameters larger than the maximum cross-sectional width, so that the aerodynamic drag component can rotate freely around the longitudinally extending golf club shaft. In various example embodiments, the swung athletic implement comprising a golf club comprises a longitudinally extending golf club shaft having a maximum cross-sectional width, the first and second openings each defining round holes having diameters larger than the maximum cross-sectional width, so that the aerodynamic drag component can freely slide longitudinally on the longitudinally extending golf club shaft.

In various example embodiments, the swung athletic implement may comprise a bat, racket, stick, or any other longitudinally-extending swung member.

In various example embodiments, the aerodynamic drag system may further comprise a second aerodynamic drag component mounted on the swung athletic implement that comprises a longitudinally-extending member extending through the first and second openings of both aerodynamic drag components.

Additionally provided in various example embodiments is a method of creating aerodynamic drag for a swung athletic implement, comprising the steps of: mounting an aerodynamic drag component as described herein on a swung athletic implement that comprises a longitudinally-extending member, such that the longitudinally-extending member extends through the first and second openings; swinging the athletic implement through a first swing portion such that air moves past the outer profile, at least in part, in the first direction moving from the lower portion toward the upper portion, causing the concave lips to scoop air from outside the hollow thin-walled body, through the perforations, and into the hollow thin-walled body, increasing aerodynamic drag; swinging the athletic implement through a second swing portion such that air moves perpendicularly to at least some of the perforations located between the lower portion and the upper portion, causing additional air from outside the hollow thin-walled body to move through the perforations and into the hollow thin-walled body, further increasing aerodynamic drag; and swinging the athletic implement through a third swing portion such that air moves past the outer profile, at least in part, in the second direction moving from the upper portion toward the lower portion, causing the convex sides to divert air outside the hollow thin-walled body away from the perforations, reducing airflow into the hollow thin-walled body, and reducing aerodynamic drag.

In various example embodiments, the step of mounting the aerodynamic drag component on a swung athletic implement further comprises mounting two such aerodynamic drag components on the swung athletic implement such that the longitudinally-extending member extends through the first and second openings of both of the aerodynamic drag components.

In various example embodiments, the step of mounting the aerodynamic drag component on a swung athletic implement further comprises mounting the aerodynamic drag component on the swung athletic implement so that the aerodynamic drag component rotates freely around the longitudinally-extending member. In various example embodiments, the step of mounting the aerodynamic drag component on a swung athletic implement further comprises mounting the aerodynamic drag component on the swung athletic implement so that the aerodynamic drag component freely slides longitudinally on the longitudinally-extending member.

In various example embodiments, the method may further comprise the step of hitting a ball with the swung athletic implement during the second swing portion.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure. It will be understood that certain components and details may not appear in the Figure(s) to assist in more clearly describing the invention.

DETAILED DESCRIPTION OF EXAMPLE EMBODIMENTS

Reference is made herein to some specific examples of the present invention, including any best modes contemplated by the inventor for carrying out the invention. Examples of these specific embodiments are illustrated in the accompanying Figure(s), including those in the '118 Application, incorporated herein. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Figure 1:
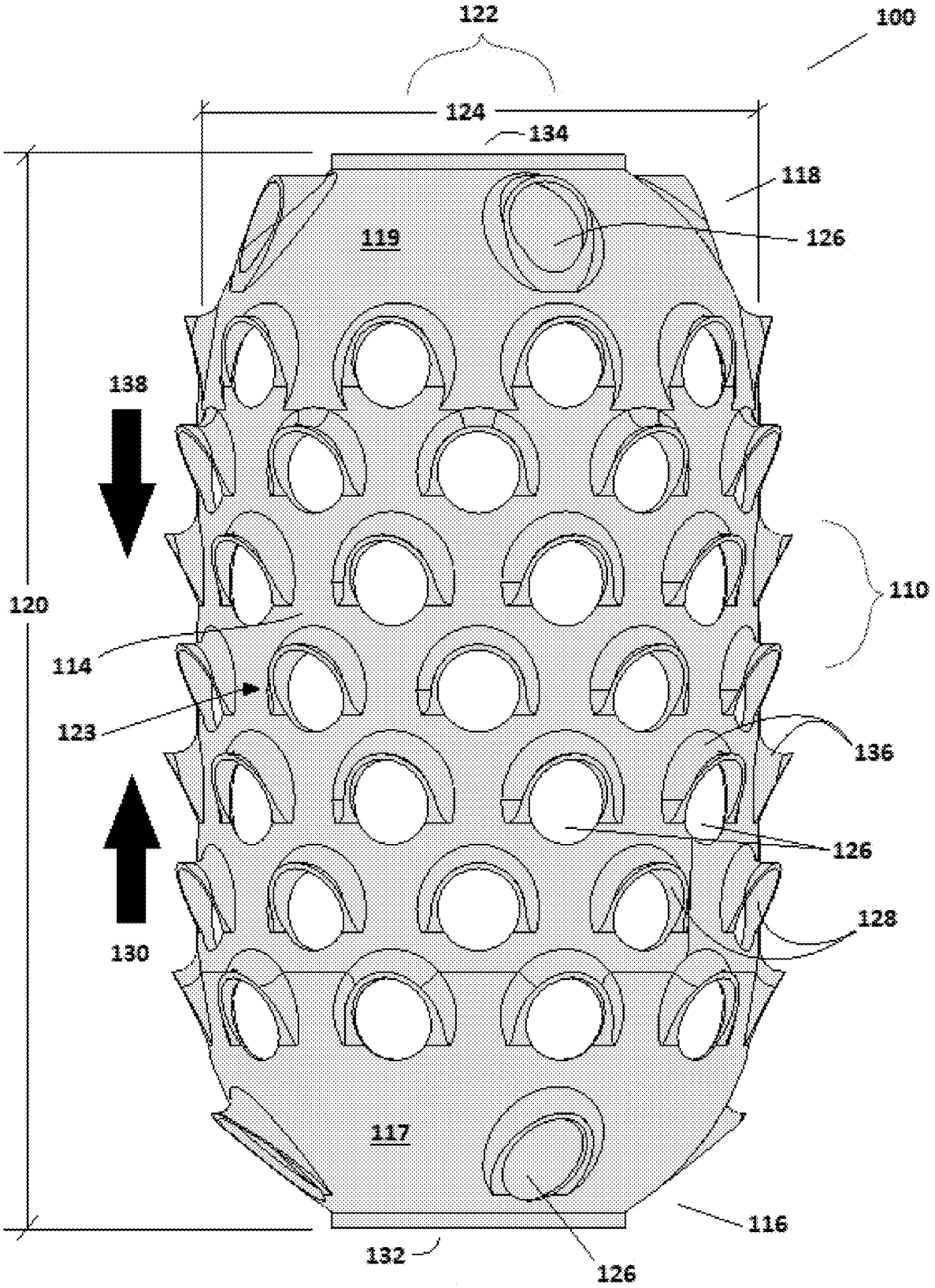
FIG. 1 is front elevation view of an example aerodynamic drag component for swung athletic implements, according to various example embodiments.
Figure 2:
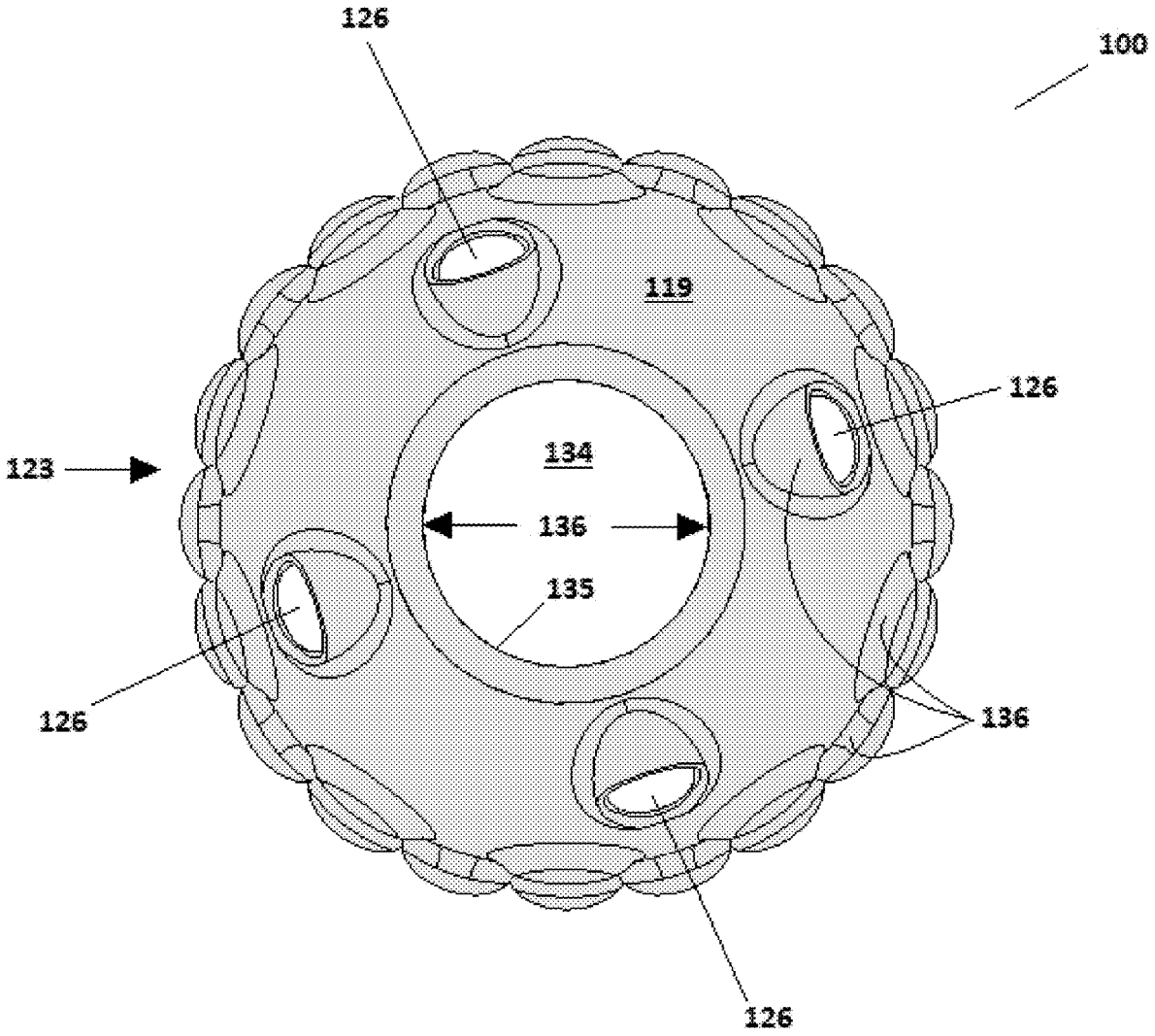
FIG. 2 is a top plan view of the example component of FIG. 1.
Figure 3:
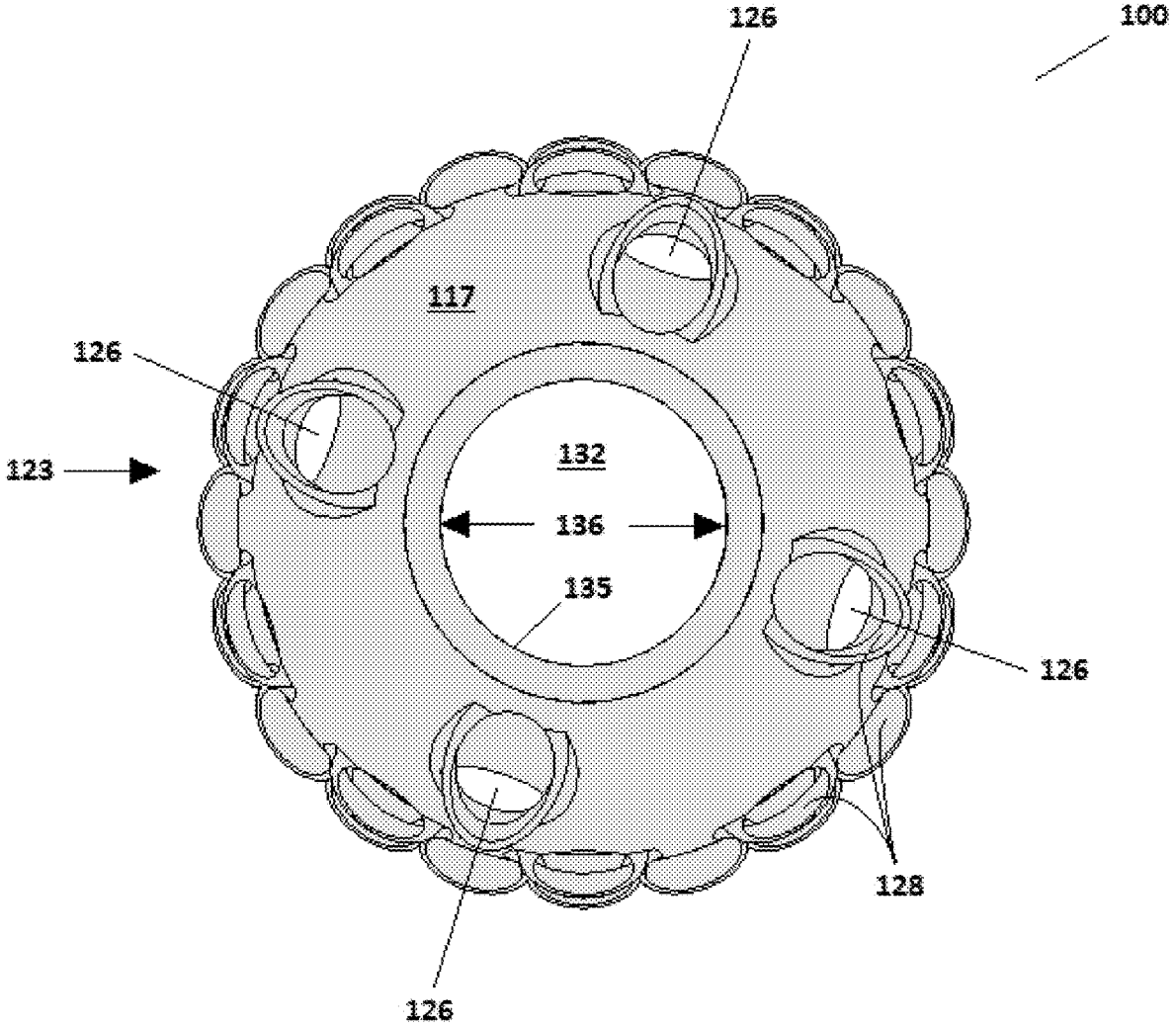
FIG. 3 is a bottom plan view of the example component of FIG. 1.
Figure 4:
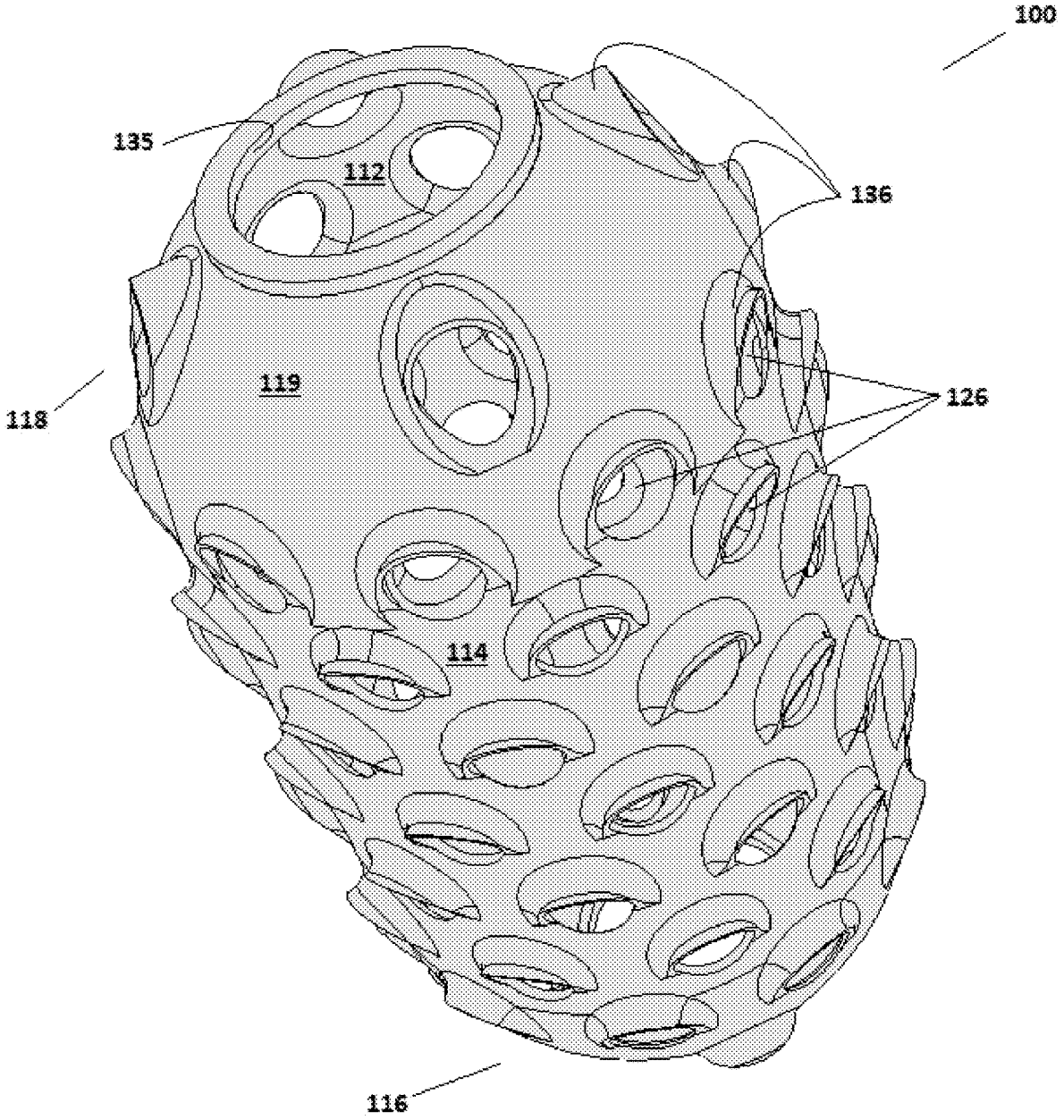
FIG. 4 is top perspective view of the example component of FIG. 1.
Figure 5:
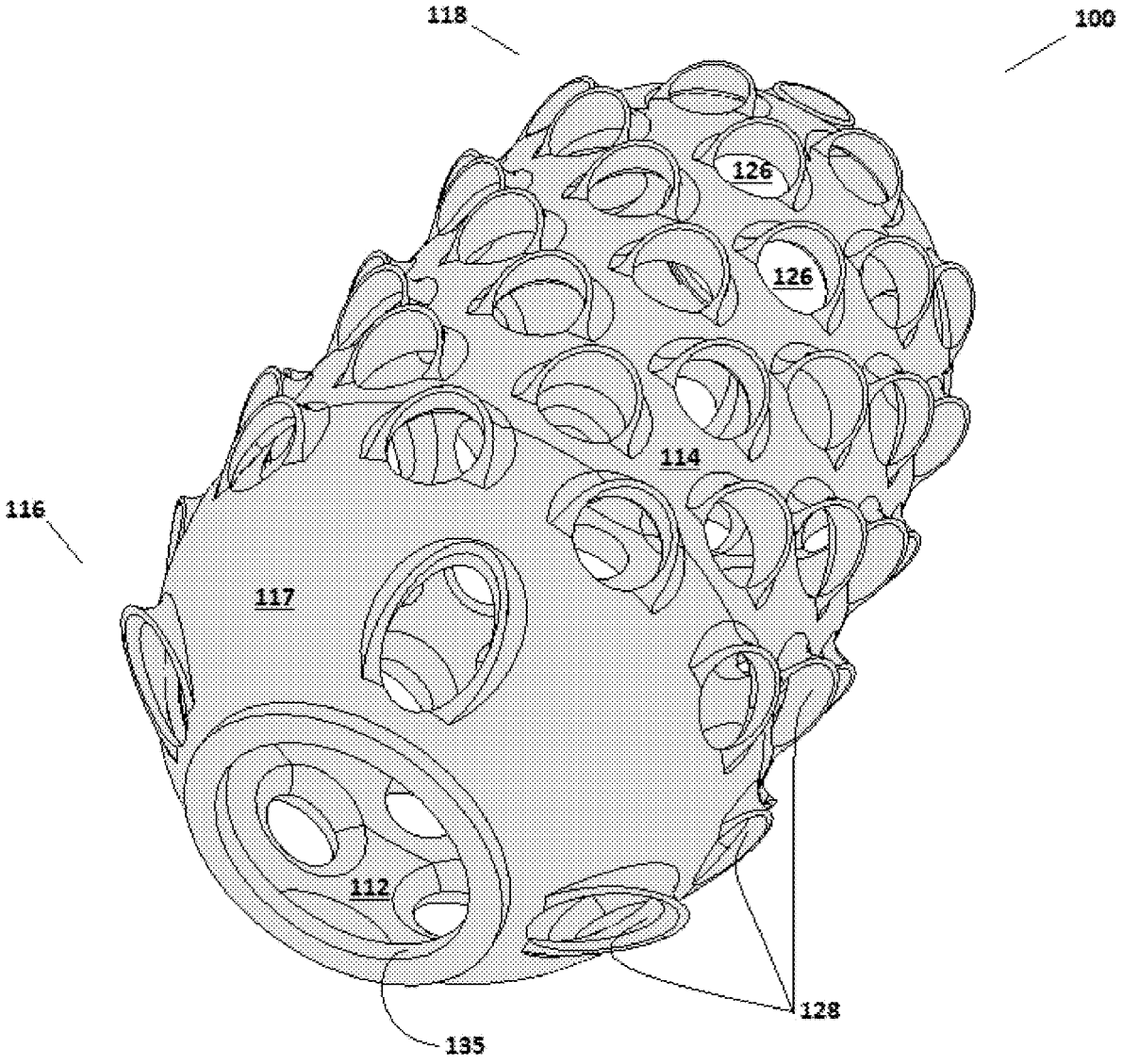
FIG. 5 is bottom perspective view of the example component of FIG. 1.
Figure 6A:
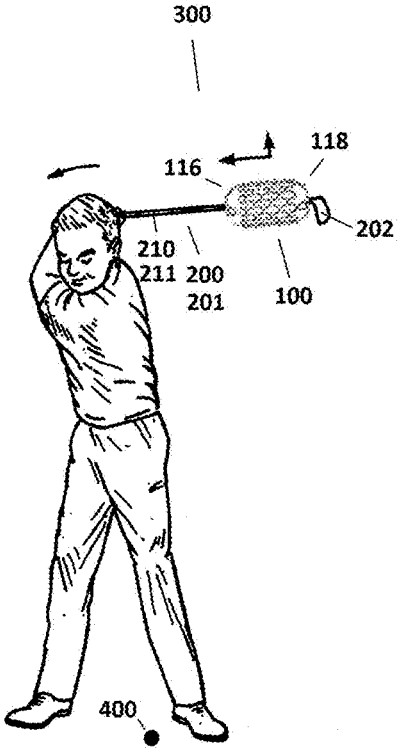
FIGS. 6A through 6E illustrate an aerodynamic drag system according to various example embodiments, comprising the aerodynamic drag component of FIG. 1 mounted on an example swung athletic implement, namely a golf club, depicting movement of the aerodynamic drag system through an example swing trajectory.
Figure 6B:
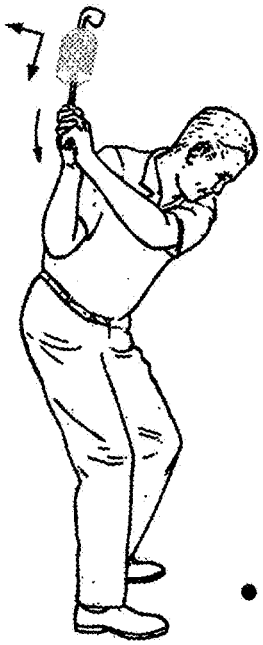
Figure 6C:
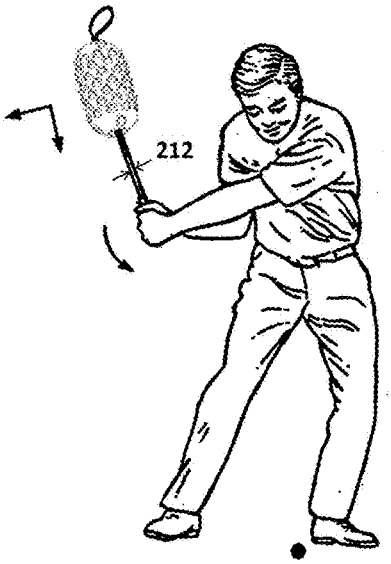
Figure 6D:
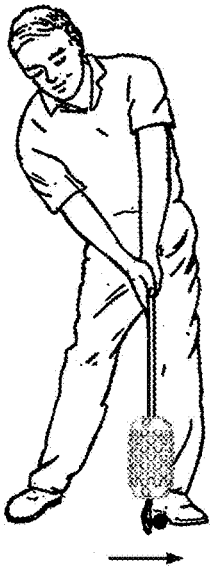
Figure 6E:
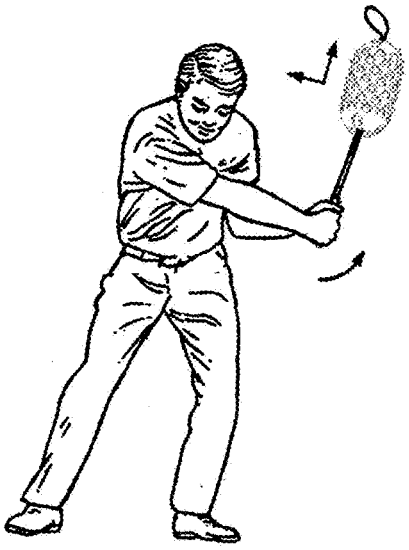

Turning to FIGS. 1 through 6E, shown is an example aerodynamic drag component 100 for a swung athletic implement 200 that comprises a longitudinally-extending member 210. The aerodynamic drag component 100 may comprise a hollow thin-walled body 110 (formed from ABS plastic or nylon material, for example) having an inner surface 112 and an outer surface 114 and extending longitudinally from a lower portion 116 to an upper portion 118 and defining there between a height 120 (such as about five, six, or seven inches, for example). The outer surface 114 may define an outer profile 122 having a maximum width 124 perpendicular to the height 120 that is less than the height 120, such as, in various example embodiments, 75%, 66%, or 50% or less of the height 120. The outer profile 122 may define a plurality of spaced-apart perforations 126 through the thin-walled body 110, at least some of the plurality of perforations 126 each defining, on a side of the perforation 126 nearest the upper portion 118, a concave lip 128 extending outward from the outer surface 114 and shaped to scoop air from outside the hollow thin-walled body 110, through the perforations 126, and into the hollow thin-walled body 110 to increase aerodynamic drag, when air moves past the outer profile 122 in a first direction 130 moving from the lower portion 116 toward the upper portion 118. First and second openings 132, 134 may be formed in the lower portion 116 and upper portion 118, respectively, the first and second openings 132, 134 sized and shaped to receive there through the longitudinally-extending member 210 of the swung athletic implement 200.

In various example embodiments, the concave lips 128 may each further comprise convex sides 136 opposite the perforations 126, the convex sides 136 extending outward from the outer surface 114 and shaped to divert air outside the hollow thin-walled body 110 away from the perforations 126, to reduce airflow into the hollow thin-walled body 110 to reduce aerodynamic drag, when air moves past the outer profile 122 in a second direction 138 opposite the first direction 130, moving from the upper portion 118 toward the lower portion 116.

In various example embodiments, the outer profile 122 may comprise a cylindrical shape 123 extending between the lower portion 116 and the upper portion 118. In various example embodiments, the lower portion 116 may comprise a first rounded surface 117 tapering inward from the cylindrical shape 123 toward the first opening 132. In various example embodiments, the upper portion 118 may further comprise a second rounded surface 119 tapering inward from the cylindrical shape 123 toward the second opening 134. In various example embodiments, the first rounded surface 117 or the second rounded surface 119 or both may further comprise some of the plurality of perforations 126.

In various example embodiments, the first and second openings 132, 134 may each define round holes 135 as shown in the present Figures, or any other suitable shape, such as, in certain non-sliding embodiments, the frictional coupling 58 of McCafferty, for example. In other example embodiments, the aerodynamic drag component 100 may be sized and shaped to rotate freely around a swung athletic implement 200 that comprises a longitudinally-extending member 210 having a maximum cross-sectional width 212, the first and second openings 132, 134 each defining round holes 135 having diameters 136 larger than the maximum cross-sectional width 212. In various example embodiments, the aerodynamic drag component 100 may be sized and shaped to freely slide longitudinally on a swung athletic implement 200 that comprises a longitudinally-extending member 210 having a maximum cross-sectional width 212, the first and second openings 132, 134 each defining round holes 135 having diameters 136 larger than the maximum cross-sectional width 212.

With reference to the '118 Application, incorporated herein by reference, in various example embodiments more than one such aerodynamic drag component 100 may be removably attached together, such as where the upper portion 118 and the lower portion 116 are sized and shaped so that the upper portion 118 of a first aerodynamic drag component 100 can fixedly and removably engage with the lower portion 116 of a second aerodynamic drag component 100 (see, e.g., the threaded or snap joints "D" in the '118 Application). For example, as will be apparent to persons of skill in the art of mechanical design in view of this disclosure, round holes 135 in the upper portion 118 and the lower portion 116 may be provided with adjacent male threads or engagement members (not shown) on the outer surface 114 of the upper portion 118 and corresponding female threads or engagement members (not shown) on the inner surface 112 of the lower portion 116, or vice-versa, so that any number of aerodynamic drag components 100 may be removably attached together.

Referring to present FIGS. 1 through 6E and the references incorporated herein by reference, provided in various example embodiments is an aerodynamic drag system 300, comprising an aerodynamic drag component 100 mounted on a swung athletic implement 200 that comprises a longitudinally-extending member 210 extending through the first and second openings 132, 134. In various example embodiments of the aerodynamic drag system 300, the swung athletic implement 200 may comprise a golf club 201 comprising a longitudinally extending golf club shaft 211 having a maximum cross-sectional width 212, wherein the first and second openings 132, 134 each define round holes 135 having diameters 136 larger than the maximum cross-sectional width 212, so that the aerodynamic drag component 100 can rotate freely around the longitudinally extending golf club shaft 211, or freely slide longitudinally on the longitudinally extending golf club shaft 211, or both. The head 202 of the golf club 201 is larger than diameters 136 so that the aerodynamic drag component 100 normally rests against the head 202 of the golf club 201 (for instance due to gravity or centrifugal force) but does not pass over the head 202 of the golf club 201. In other example embodiments of the aerodynamic drag system 300, the swung athletic implement 200 may comprise a bat (see, e.g., McCafferty), in which case the far end of the bat (i.e., the end furthest away from the user's hands when swinging the bat), which has the largest cross-sectional diameter, is larger than diameters 136, so that the aerodynamic drag component 100 normally rests against the far end of the bat (for instance due to gravity or centrifugal force) but does not pass over the far end of the bat. Similar abutments or structures limiting longitudinal movement of the aerodynamic drag system 300 off the far end (i.e., the end furthest away from the user's hands when swinging the implement 200) of the swung athletic implement 200 may be provided in other example embodiments (with respect to, for example, rackets, sticks, or other swung athletic implements 200), as will be apparent to persons of skill in the art in view of this disclosure.

With reference to the '118 Application, in various example embodiments the aerodynamic drag system 300 may further comprise a second (or third, or fourth, or any suitable number) aerodynamic drag component 100 mounted on the swung athletic implement 200 that comprises a longitudinally-extending member 210 extending through the first and second openings 132, 134 of all aerodynamic drag components 100. The multiple aerodynamic drag components 100 may or may not be attached together during use in various example embodiments.

With particular reference to present FIGS. 6A through 6E, an example aerodynamic drag system 300 will be described in use with respect to golf swing training, as an example. One or more aerodynamic drag component(s) 100 may be mounted on a swung athletic implement 200 that comprises a longitudinally-extending member 210, such that the longitudinally-extending member 210 extends through the first and second openings 132, 134, and so that the upper portion(s) 118 of the aerodynamic drag component(s) 100 are positioned furthest away from the user's hands, for instance, the upper portion(s) 118 of the aerodynamic drag component(s) 100 may be positioned nearest the golf club head 202.

For example, as depicted by the vector arrows in FIGS. 6A through 6E, starting from the top of the swing (FIG. 6A), where the user's forearms are typically positioned at about a 90 degree angle to the golf club shaft 211, the aerodynamic drag component 100 goes from being pulled mostly longitudinally into the air, to being pulled partially longitudinally into the air and partially tangentially into the air, as the user rotates their wrists to align the golf club shaft 211 with their forearms (FIGS. 6B, 6C); to moving only tangentially into the air at the bottom of the swing (FIG. 6D) when the golf club shaft 211 is aligned with the user's forearms; to a combination of pushing longitudinally into the air and tangentially into the air on the upswing (FIG. 6E), as the user continues to rotate the golf club shaft 211 relative to their forearms. The vector arrows in FIGS. 6A through 6E indicate direction of movement of the aerodynamic drag component 100; accordingly, air movement relative to the component 100 would be in the opposite directions of those vector arrows.

On the downswing (FIGS. 6A, 6B, 6C), the concave lips 128 extending outward from the outer surface 114 scoop air from outside the hollow thin-walled body 110, through the perforations 126, and into the hollow thin-walled body 110, increasing drag, as air moves past the outer profile 122 at least in part in a first direction 130 moving from the lower portion 116 toward the upper portion 118.

At the bottom of the swing (FIG. 6D) the concave lips 128 likely have little if any effect on drag compared to regular holes, since the aerodynamic drag component 100 is, at least theoretically, moving only tangentially into the air at the bottom of the swing, as depicted by the horizontal vector arrow.

On the upswing (FIG. 6E), the convex sides 136 opposite the perforations 126 and extending outward from the outer surface 114 block some air from entering the interior, thus reducing drag, as air moves past the outer profile 122 in a second direction 138 opposite the first direction 130, moving from the upper portion 118 toward the lower portion 116. The impact of the air with the convex sides 136 on the upswing creates some drag, but likely far less than the drag created by the impact of the air with the concave lips 128 on the downswing.

Thus, in addition to varied drag resistance created by different velocities of movement, the present system 300 in various example embodiments can create a variable resistance at different points of a swing. For example, at the start of the swing, as the swung athletic implement 200 starts to move, the perforations 126 are designed to start to gathering air into the interior of the aerodynamic drag component 100, with assistance from the concave lips 128. As the swing progresses toward an impact zone with the ball 400, the aerodynamic drag component 100 can provide maximum aerodynamic drag, and as the swing continues through past the ball 400, the aerodynamic drag starts to fade. That dynamic is believed to be unique to the present designs and cannot be achieved by using a large perforated sphere or other designs previously suggested in the art. The present designs are believed to provide maximum resistance in the approximately 45 degrees of the swing immediately prior to impact with the ball 400, not just to provide velocity-based resistance at all points of the swing.

Accordingly, provided in various example embodiments is a method of creating aerodynamic drag for a swung athletic implement 200, which may comprise the steps of: mounting an aerodynamic drag component 100 on a swung athletic implement 200 that comprises a longitudinally-extending member 210, such that the longitudinally-extending member 210 extends through the first and second openings 132, 134; swinging the athletic implement 200 through a first swing portion (e.g., FIGS. 6A, 6B, 6C) such that air moves past the outer profile 122, at least in part, in the first direction 130 moving from the lower portion 116 toward the upper portion 118, causing the concave lips 128 to scoop air from outside the hollow thin-walled body 110, through the perforations 126, and into the hollow thin-walled body 110, increasing aerodynamic drag; swinging the athletic implement 200 through a second swing portion (e.g., FIG. 6D) such that air moves perpendicularly to at least some of the perforations 126 located between the lower portion 116 and the upper portion 118, causing additional air from outside the hollow thin-walled body 110 to move through the perforations 126 and into the hollow thin-walled body 110, further increasing aerodynamic drag; and swinging the athletic implement 200 through a third swing portion (e.g., FIG. 6E) such that air moves past the outer profile 122, at least in part, in the second direction 138 moving from the upper portion 118 toward the lower portion 116, causing the convex sides 136 to divert air outside the hollow thin-walled body 110 away from the perforations 126, reducing airflow into the hollow thin-walled body 110, and reducing aerodynamic drag.

In various example embodiments, the step of mounting the aerodynamic drag component 100 on a swung athletic implement 200 may further comprise mounting two or more such aerodynamic drag components 100 (whether or not the aerodynamic drag components 100 are connected together) on the swung athletic implement 200 such that the longitudinally-extending member 210 extends through the first and second openings 132, 134 of all of the aerodynamic drag components 100. In various example embodiments, the step of mounting the aerodynamic drag component(s) 100 on a swung athletic implement 200 further comprises mounting the aerodynamic drag component(s) 100 on the swung athletic implement 200 so that the aerodynamic drag component(s) 100 rotate freely around the longitudinally-extending member 210. In various example embodiments, the step of mounting the aerodynamic drag component(s) 100 on a swung athletic implement 200 further comprises mounting the aerodynamic drag component(s) 100 on the swung athletic implement 200 so that the aerodynamic drag component(s) 100 freely slide longitudinally on the longitudinally-extending member 210. In various example embodiments, the method may further comprise the step of hitting a ball 400 with the swung athletic implement 200 during the second swing portion (e.g., FIG. 6D), while the aerodynamic drag component(s) 100 are mounted on the swung athletic implement 200.

In embodiments where the aerodynamic drag component (s) 100 freely slide longitudinally on the longitudinally-extending member 210, an additional training exercise is facilitated that can be useful in sports where, as part of the user swinging the swung athletic implement 200, the user "snaps" (or "rolls" or "throws") her or his wrist(s), typically as the swung athletic implement 200 approaches the ball 400 or other item to be hit, to maximize speed and power. For example with respect to golf, a user can hold the golf club 201 horizontally with the user's arms outstretched in front of her or him, with the aerodynamic drag component(s) 100 located nearest the user's hands. The user can then, in that position, practice the portion of the swing where the user "snaps" or rolls her or his wrists, which imparts centrifugal force on the slidable aerodynamic drag component(s) 100, causing them to suddenly accelerate and travel down the golf club shaft 211 and impact the golf club head 202. The timing of this motion, including the rapidity of the sliding of the aerodynamic drag component(s) 100 and the resulting location in the swing where the aerodynamic drag component(s) 100 impact the golf club head 202, can be used to train a user how and when to "snap" their wrists during the golf swing. For example, the user may be trained to perform this action so that aerodynamic drag component(s) 100 impact the golf club head 202 at the point of the swing when the golf club head 202 would impact the ball 400.

Any of the suitable technologies and materials set forth and incorporated herein may be used to implement various example aspects of the invention as would be apparent to one of skill in the art. Although exemplary embodiments and applications of the invention have been described herein including as described above and shown in the included example Figure(s), there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. An aerodynamic drag component for a swung athletic implement that comprises a longitudinally-extending member, the aerodynamic drag component comprising:

a hollow thin-walled body having an inner surface and an outer surface and extending longitudinally from a lower portion to an upper portion and defining there between a height, the outer surface defining an outer profile having a maximum width perpendicular to the height that is less than or equal to 75 percent of the height;

the outer profile defining a plurality of spaced-apart perforations through the thin-walled body, at least some of the plurality of perforations each defining, on a side of the perforation nearest the upper portion, a concave lip extending outward from the outer surface and shaped to scoop air from outside the hollow thin-walled body, through the perforations, and into the hollow thin-walled body to increase aerodynamic drag, when air moves past the outer profile in a first direction moving from the lower portion toward the upper portion; and first and second openings formed in the lower portion and upper portion, respectively, the first and second openings sized and shaped to receive there through the longitudinally-extending member of the swung athletic implement.

2. The aerodynamic drag component of claim 1, further comprising the outer surface defining an outer profile having a maximum width perpendicular to the height that is less than or equal to 66 percent of the height.

3. The aerodynamic drag component of claim 1, further comprising the outer surface defining an outer profile having a maximum width perpendicular to the height that is less than or equal to 50 percent of the height.

4. The aerodynamic drag component of claim 1, the outer profile further comprising a cylindrical shape extending between the lower portion and the upper portion.

5. The aerodynamic drag component of claim 4, the lower portion further comprising a first rounded surface tapering inward from the cylindrical shape toward the first opening, and the upper portion further comprising a second rounded surface tapering inward from the cylindrical shape toward the second opening.

6. The aerodynamic drag component of claim 5, the first rounded surface and the second rounded surface each further comprising some of the plurality of perforations.

7. The aerodynamic drag component of claim 1, the first and second openings each defining round holes.

8. The aerodynamic drag component of claim 1, sized and shaped to rotate freely around a swung athletic implement that comprises a longitudinally-extending member having a maximum cross-sectional width, the first and second openings each defining round holes having diameters larger than the maximum cross-sectional width.

9. The aerodynamic drag component of claim 1, sized and shaped to freely slide longitudinally on a swung athletic implement that comprises a longitudinally-extending member having a maximum cross-sectional width, the first and second openings each defining round holes having diameters larger than the maximum cross-sectional width.

10. The aerodynamic drag component of claim 1 where more than one such aerodynamic drag component may be removably attached together, further comprising the upper portion and the lower portion are sized and shaped so that the upper portion of a first aerodynamic drag component can fixedly and removably engage with the lower portion of a second aerodynamic drag component.

11. An aerodynamic drag system, comprising the aerodynamic drag component of claim 1 mounted on a swung athletic implement that comprises a longitudinally-extending member extending through the first and second openings.

12. The aerodynamic drag system of claim 11, the swung athletic implement comprising a golf club.

13. The aerodynamic drag system of claim 11, the swung athletic implement comprising a golf club comprises a longitudinally extending golf club shaft having a maximum cross-sectional width, the first and second openings each defining round holes having diameters larger than the maximum cross-sectional width, so that the aerodynamic drag component can rotate freely around the longitudinally extending golf club shaft.

14. The aerodynamic drag system of claim 11, the swung athletic implement comprising a golf club comprises a longitudinally extending golf club shaft having a maximum cross-sectional width, the first and second openings each defining round holes having diameters larger than the maximum cross-sectional width, so that the aerodynamic drag component can freely slide longitudinally on the longitudinally extending golf club shaft.

15. The aerodynamic drag system of claim 11, the swung athletic implement comprising a bat.

16. The aerodynamic drag system of claim 11, further comprising a second aerodynamic drag component mounted on the swung athletic implement that comprises a longitudinally-extending member extending through the first and second openings of both aerodynamic drag components.

17. An aerodynamic drag component for a swung athletic implement that comprises a longitudinally-extending member, the aerodynamic drag component comprising:

a hollow thin-walled body having an inner surface and an outer surface and extending longitudinally from a lower portion to an upper portion and defining there between a height, the outer surface defining an outer profile having a maximum width perpendicular to the height that is less than the height;

the outer profile defining a plurality of spaced-apart perforations through the thin-walled body, at least some of the plurality of perforations each defining, on a side of the perforation nearest the upper portion, a concave lip extending outward from the outer surface and shaped to scoop air from outside the hollow thin-walled body, through the perforations, and into the hollow thin-walled body to increase aerodynamic drag, when air moves past the outer profile in a first direction moving from the lower portion toward the upper portion;

first and second openings formed in the lower portion and upper portion, respectively, the first and second openings sized and shaped to receive there through the longitudinally-extending member of the swung athletic implement; and the concave lips each further comprising convex sides opposite the perforations, the convex sides extending outward from the outer surface and shaped to divert air outside the hollow thin-walled body away from the perforations, to reduce airflow into the hollow thin-walled body to reduce aerodynamic drag, when air moves past the outer profile in a second direction opposite the first direction, moving from the upper portion toward the lower portion.

18. A method of creating aerodynamic drag for a swung athletic implement, comprising the steps of:

mounting the aerodynamic drag component of claim 17 on a swung athletic implement that comprises a longitudinally-extending member, such that the longitudinally-extending member extends through the first and second openings;

swinging the athletic implement through a first swing portion such that air moves past the outer profile, at least in part, in the first direction moving from the lower portion toward the upper portion, causing the concave lips to scoop air from outside the hollow thin-walled body, through the perforations, and into the hollow thin-walled body, increasing aerodynamic drag;

swinging the athletic implement through a second swing portion such that air moves perpendicularly to at least some of the perforations located between the lower portion and the upper portion, causing additional air from outside the hollow thin-walled body to move through the perforations and into the hollow thin-walled body, further increasing aerodynamic drag; and swinging the athletic implement through a third swing portion such that air moves past the outer profile, at least in part, in the second direction moving from the upper portion toward the lower portion, causing the convex sides to divert air outside the hollow thin-walled body away from the perforations, reducing airflow into the hollow thin-walled body, and reducing aerodynamic drag.

19. The method of claim 18, the step of mounting the aerodynamic drag component on a swung athletic implement further comprising mounting two such aerodynamic drag components on the swung athletic implement such that the longitudinally-extending member extends through the first and second openings of both of the aerodynamic drag components.

20. The method of claim 18, the step of mounting the aerodynamic drag component on a swung athletic implement further comprising mounting the aerodynamic drag component on the swung athletic implement so that the aerodynamic drag component rotates freely around the longitudinally-extending member.

21. The method of claim 18, the step of mounting the aerodynamic drag component on a swung athletic implement further comprising mounting the aerodynamic drag component on the swung athletic implement so that the aerodynamic drag component freely slides longitudinally on the longitudinally-extending member.

22. The method of claim 18, further comprising the step of hitting a ball with the swung athletic implement during the second swing portion.

* * * * *